US010550813B2

(12) United States Patent
Di Domizio et al.

(10) Patent No.: US 10,550,813 B2
(45) Date of Patent: Feb. 4, 2020

(54) FUEL INJECTION ASSEMBLY

(71) Applicant: Continental Automotive GmbH, Hannover (DE)

(72) Inventors: Gisella Di Domizio, San Giuliano Terme (IT); Matteo Soriani, Leghorn (IT)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 0 days.

(21) Appl. No.: 15/125,352

(22) PCT Filed: Feb. 19, 2015

(86) PCT No.: PCT/EP2015/053515
§ 371 (c)(1),
(2) Date: Sep. 12, 2016

(87) PCT Pub. No.: WO2015/135732
PCT Pub. Date: Sep. 17, 2015

(65) Prior Publication Data

US 2017/0096977 A1 Apr. 6, 2017

(30) Foreign Application Priority Data

Mar. 14, 2014 (EP) ..... 14159677

(51) Int. Cl.
*F02M 61/14* (2006.01)
*F02M 51/00* (2006.01)
*F02M 69/46* (2006.01)

(52) U.S. Cl.
CPC ..... *F02M 61/14* (2013.01); *F02M 51/005* (2013.01); *F02M 69/462* (2013.01); *F02M 2200/852* (2013.01)

(58) Field of Classification Search
CPC ..... F02M 61/14; F02M 51/005; F02M 2200/852; F02M 2200/853;
(Continued)

(56) References Cited

U.S. PATENT DOCUMENTS 5,301,647 A * 4/1994 Lorraine ..... F02M 55/004 123/456
5,350,314 A 9/1994 Saba ..... 439/378
(Continued)

FOREIGN PATENT DOCUMENTS

CN 102414430 A 4/2012 ..... F02M 51/06
EP 2014909 A2 1/2009 ..... F02M 61/14
(Continued)

OTHER PUBLICATIONS

EP 1906005 B1, U.S. Pat. No. 7,802,559 B2.
(Continued)

*Primary Examiner* — Hung Q Nguyen
*Assistant Examiner* — Brian P Monahon
(74) *Attorney, Agent, or Firm* — Slayden Grubert Beard PLLC

(57) ABSTRACT

The present disclosure relates in general to injectors and, more specifically, to a fuel injection assembly that may be used in an internal combustion engine. In some embodiments, a fuel injection assembly may include: a fuel injector with a fuel inlet port and a fuel outlet end; and an injector cup with a recess receiving the fuel inlet port of the fuel injector through an opening of the recess. The injector cup comprises a collar extending circumferentially around the opening. The injector cup comprises a tab extending longitudinally beyond the opening in a direction towards the fuel outlet end. The tab projects axially beyond the collar in a longitudinal direction towards the fuel outlet end. The fuel injector comprises a pocket receiving the tab.

7 Claims, 2 Drawing Sheets

(58) Field of Classification Search
CPC ..... F02M 2200/856; F02M 2200/858; F02M 2200/857; F02M 61/10; F02M 61/145
See application file for complete search history.

(56) References Cited

U.S. PATENT DOCUMENTS

| | | | | | |
|---|---|---|---|---|---|
| 5,458,096 | A * | 10/1995 | Hollis | F01P 7/167 | 123/41.1 |
| 5,598,824 | A * | 2/1997 | Treusch | F02M 51/005 | 123/456 |
| 5,641,126 | A * | 6/1997 | Nally | F02M 61/145 | 239/575 |
| 5,820,099 | A * | 10/1998 | Rahbar | F02M 51/005 | 251/129.15 |
| 5,970,953 | A | 10/1999 | Lorraine et al. | 123/470 | |
| 6,148,797 | A * | 11/2000 | Gmelin | F02M 55/025 | 123/456 |
| 6,338,333 | B1 * | 1/2002 | Brosseau | F02M 35/10085 | 123/456 |
| 6,382,187 | B1 | 5/2002 | Scollard et al. | 123/470 | |
| 6,419,282 | B1 * | 7/2002 | Hornby | F02M 55/004 | 277/613 |
| 6,830,037 | B1 * | 12/2004 | Braun | F02M 63/0225 | 123/470 |
| 6,874,477 | B1 * | 4/2005 | Lorraine | F02M 61/145 | 123/456 |
| 7,107,969 | B2 * | 9/2006 | Norcutt | F02M 55/02 | 123/470 |
| 7,398,767 | B2 * | 7/2008 | Kondo | F02M 61/145 | 123/468 |
| 7,438,055 | B1 * | 10/2008 | Xu | F02M 61/14 | 123/456 |
| 7,765,984 | B2 * | 8/2010 | Fuerst | F02M 55/025 | 123/456 |
| 7,802,559 | B2 * | 9/2010 | Furst | F02M 61/14 | 123/470 |
| 8,646,434 | B2 * | 2/2014 | Harvey | F02M 55/005 | 123/456 |
| 8,813,722 | B2 * | 8/2014 | Harvey | F02M 55/005 | 123/456 |
| 8,826,890 | B2 | 9/2014 | Sato | 123/470 | |
| 9,109,563 | B2 * | 8/2015 | Roseborsky | F02M 61/14 | |
| 9,617,961 | B2 * | 4/2017 | Harvey | F02M 55/005 | |
| 2003/0183200 | A1 * | 10/2003 | Bugos | F02M 55/025 | 123/470 |
| 2005/0211225 | A1 * | 9/2005 | Oguma | F02M 51/005 | 123/470 |
| 2006/0137659 | A1 | 6/2006 | Zdroik et al. | 123/470 | |
| 2008/0264386 | A1 * | 10/2008 | Watanabe | F02M 55/02 | 123/456 |
| 2009/0013968 | A1 * | 1/2009 | Keegan | F02M 55/005 | 123/470 |
| 2009/0084358 | A1 * | 4/2009 | Zdroik | F02M 69/465 | 123/470 |
| 2010/0218743 | A1 * | 9/2010 | Marc | F02M 55/025 | 123/470 |
| 2010/0275883 | A1 * | 11/2010 | Hohkita | F02M 55/025 | 123/456 |
| 2010/0300406 | A1 * | 12/2010 | Harvey | F02M 55/025 | 123/456 |
| 2011/0232609 | A1 * | 9/2011 | Roseborsky | F02M 61/14 | 123/470 |
| 2013/0074951 | A1 * | 3/2013 | Marc | F02M 61/14 | 137/343 |
| 2013/0192565 | A1 * | 8/2013 | Roseborsky | F02M 61/14 | 123/470 |
| 2014/0203110 | A1 * | 7/2014 | Fischer | F02M 37/0017 | 239/584 |
| 2015/0101572 | A1 * | 4/2015 | Serra | F02M 61/14 | 123/470 |
| 2016/0003205 | A1 * | 1/2016 | Reinhardt | F02M 61/14 | 123/470 |

FOREIGN PATENT DOCUMENTS

| | | | | |
|---|---|---|---|---|
| EP | 1906005 | B1 | 6/2009 | F02M 61/14 |
| JP | 10205409 | A | 8/1998 | F02M 55/02 |
| JP | 2013072283 | A | 4/2013 | F02M 51/06 |
| WO | 2015/135732 | A1 | 9/2015 | F02M 51/00 |

OTHER PUBLICATIONS

European Search Report, Application No. 14159677.5, 5 pages, dated Jul. 31, 2014.
International Search Report and Written Opinion, Application No. PCT/EP2015/053515, 9 pages, dated May 26, 2015.
European Office Action, Application No. 15705990.8, 10 pages, dated Mar. 9, 2016.
Korean Office Action, Application No. 2017017600592, 12 pages, dated Mar. 9, 2017.
CN 102414430 A, U.S. Pat. No. 8,826,890 B2.
Chinese Office Action, Application No. 201580013860.1, 13 pages, dated Jan. 30, 2018.

* cited by examiner

FUEL INJECTION ASSEMBLY

CROSS-REFERENCE TO RELATED APPLICATIONS

This application is a U.S. National Stage Application of International Application No. PCT/EP2015/053515 filed Feb. 19, 2015, which designates the United States of America, and claims priority to EP Application No. 14159677.5 filed Mar. 14, 2014, the contents of which are hereby incorporated by reference in their entirety.

TECHNICAL FIELD

The present disclosure relates in general to injectors and, more specifically, to a fuel injection assembly that may be used in an internal combustion engine.

BACKGROUND

Fuel injection assemblies are in widespread use for dosing fuel from a fuel reservoir, such as a fuel rail, to an internal combustion engine, and in particular directly into combustion chambers of the internal combustion engine.

For example, EP 2014909 A2 discloses a fuel injection system with a fuel injector socket including a first attachment feature and a fuel injector including a second attachment feature that corresponds with the first attachment feature. The first attachment feature engages with the second attachment feature connecting the fuel injector to the fuel injector socket and preventing rotational movement of the fuel injector relative to the fuel injector socket. The corresponding attachment features not only enable simple connection and disconnection of a fuel injector to a fuel injector socket of a fuel rail, but can also be integrated into existing injector to fuel rail assembly processes and are applicable in any fuel injection system. The corresponding attachment features may be used with metal fabricated fuel rail assemblies as well as for fuel rail assemblies where the manifold supply tube and the fuel injector sockets are over molded with a plastic material.

SUMMARY

The present disclosure teaches improved fuel injection assemblies.

In some embodiments, a fuel injection assembly (1) having a longitudinal axis (L) may comprise: a fuel injector (10) having a fuel inlet port (110) and a fuel outlet end (120), and an injector cup (20) having a recess (210) in which the fuel inlet port (110) of the fuel injector (10) is received through an opening (215) of the recess (210). The injector cup (20) comprises a collar (230) which extends circumferentially around the opening (215). The injector cup (20) comprises a tab (220) which extends longitudinally beyond the opening (215) in direction towards the fuel outlet end (120). The tab (220) projects axially beyond the collar (230) in longitudinal direction towards the fuel outlet end (120). The fuel injector (10) comprises a pocket (130) in which the tab (220) is received.

In some embodiments, the collar (230) comprises an end surface (240) of the injector cup (20), the end surface being coplanar with the opening (215) of the recess (210).

In some embodiments, the fuel inlet port (110) is comprised by a metallic tubular body (12) of the fuel injector (10) and the pocket (130) is comprised by a plastic housing (14) which laterally surrounds the metallic tubular body (12).

In some embodiments, a the pocket (130) extends into the plastic housing (14) from an opening of the pocket to a bottom surface of the pocket in longitudinal direction (L) towards the fuel outlet end (120) of the fuel injector (10).

In some embodiments, the tab (220) is inserted in longitudinal direction (L) into the pocket through the opening in such fashion that it is axially displaceable in reciprocating fashion relative to the pocket (130).

In some embodiments, the fuel injector (10) comprises an electrical connector (140) which, in top view along the longitudinal axis (L), is arranged subsequent to the pocket (130) in radial direction away from the metallic tubular body (12).

In some embodiments, the injector cup (20) is a one-piece part including the tab (220) and recess (210).

In some embodiments, the assembly further comprises a spring clip (30) which is arranged and preloaded in longitudinal direction between a shoulder (150) of the fuel injector (10) and an end surface (240) of the injector cup (20).

BRIEF DESCRIPTION OF THE DRAWINGS

Further advantages and advantageous embodiments and developments of the fuel injection assembly will become apparent from the following exemplary embodiments which are described in the following in connection with schematic figures.

In the figures.

In the embodiment and the figures, identical or similar elements or elements having the same function are provided with the same reference symbols.

DETAILED DESCRIPTION

Figure 1:
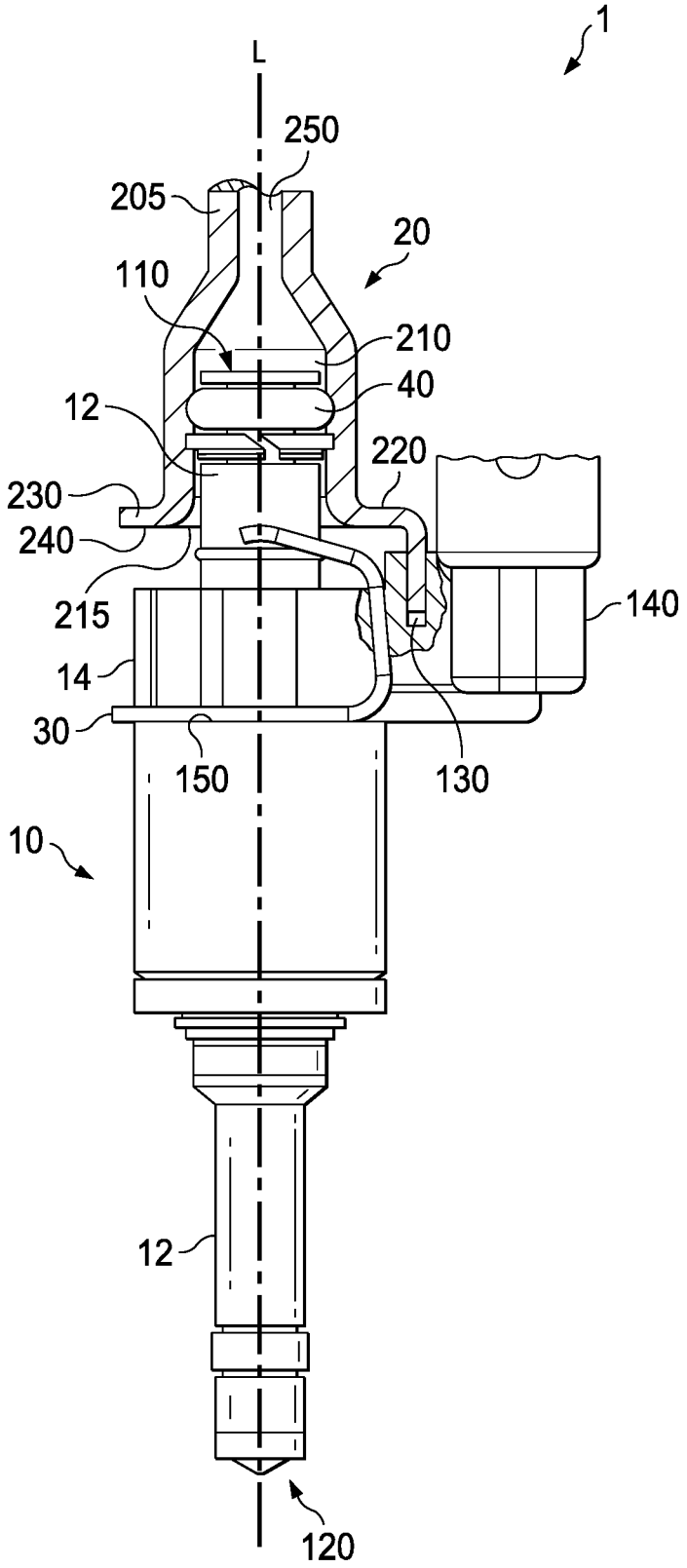
FIG. 1 shows a schematic side view of a fuel injection assembly according to a first exemplary embodiment with the injector cup and the portion of the plastic housing of the fuel injector being cut open longitudinally.

In some embodiments, the fuel injection assembly has a longitudinal axis. It comprises a fuel injector and an injector cup. The fuel injector—which also may be denoted as a fuel injection valve—has a fuel inlet port and a fuel outlet end. In particular, the fuel outlet end comprises one or more injection nozzles through which the fuel injector is operable to dispense fuel. The fuel inlet port and the fuel outlet end are arranged subsequently along the longitudinal axis, in particular at opposite longitudinal ends of the fuel injector.

In some embodiments, the injector cup has a recess in which the fuel inlet port of the fuel injector is received through an opening of the recess. In particular, a base portion of the injector cup comprises the recess and the recess extends into the base portion from the opening in longitudinal direction away from the fuel outlet end of the fuel injector. The base portion may also be denoted as a base body. During assembling the fuel injection assembly, the fuel injector is inserted into the recess trough the opening. The opening is in particular co-planar with a downstream end surface of the base portion of the injector cup.

In some embodiments, the injector cup comprises a tab which extends longitudinally beyond the opening towards the fuel outlet end. The fuel injector comprises a pocket in which the tab is received. In particular, a main extension direction of the tab is parallel to the longitudinal axis. In particular, the tab is received in the pocket trough an opening of the pocket and the pocket extends from the opening in longitudinal direction towards the fuel outlet end of the fuel injector.

In some embodiments, the injector cup is a one-piece part comprising the recess—in particular the base portion with the recess—and the tab. The injector cup, in particular the base body and the tab, may be made from a metal or from an alloy.

By means of the subject fuel injection assembly, rotational alignment of the fuel injector with respect to the injector cup—so-called "indexing" of the fuel injector relative to the injector cup—is achieved. The indexing is particularly precise and at the same time cost-effective. Small tolerances are achievable since the indexing is effected directly between the fuel injector and the injector cup without any further intervening parts (such as a spring clip) which have the risk to introduce additional tolerances. In addition, the fuel injection assembly may be operable to limit the tilt between the fuel injector and the injector cup by means of the tab which is received in the pocket.

In some embodiments, the fuel inlet port is comprised of a metallic tubular body of the fuel injector and the pocket is comprised of a plastic housing which laterally surrounds a portion of the metallic tubular body. In some embodiments, the pocket is a particularly mechanically robust element in the plastic housing. Prominent projecting portions of the plastic housing for the indexing feature, being comparatively mechanically weak and having the risk that other components could get caught during the assembling process, can be avoided.

In some embodiments, the fuel injector comprises an electrical connector. The electrical connector is in particular configured for feeding electrical power to an actuator assembly of the fuel injector. In some embodiments, the electrical connector is arranged subsequent to the pocket and the tab in radial direction away from the tubular body in top view along the longitudinal axis. In other words, the metallic tubular body, the pocket and the electrical connector follow one another in this order in radial outward direction in a protection on a common plane which is perpendicular to the longitudinal axis. The pocket and the electrical connector can be axially offset relative to one another. The electrical connector may be comprised by the plastic housing of the fuel injector. By means of such an arrangement, a particularly space-saving configuration is achievable.

In some embodiments, the injector cup comprises a collar which extends circumferentially around the opening of the recess. The collar is in particular in one piece with the base portion of the injector cup and comprises in particular the end surface of the base portion. The tab may project longitudinally beyond the collar in longitudinal direction towards the fuel outlet end of the fuel injector. For example, the injector cup is represented by a part which is in particular at least one of deep-drawn, stamped and bent and which comprises the recess, the collar and the tab. The collar may have a cut-out, and the tab merges with the base body in the region of the cut-out. In this way, a particularly cost effective and space saving configuration is achievable.

In some embodiments, the collar extends circumferentially around the recess and comprises an end surface of the injector cup. The end surface is in particular perpendicular to the longitudinal axis. The end surface may be coplanar with the opening of the recess. In other words, the end surface is perforated by the opening. The tab projecting longitudinally beyond the collar in longitudinal direction towards the fuel outlet end may be particularly well visible during assembling the fuel injection assembly so that the assembling operation may be particularly easy and/or quick. The tab may also be operable to guide the relative movement of injector and injector cup over a particularly large distance when the cup is shifted over the injector during assembling the fuel injection assembly.

In some embodiments, the pocket extends into the plastic housing from an opening of the pocket to a bottom surface of the pocket in longitudinal direction towards the fuel outlet end of the fuel injector. In this way, the assembly can be assembled particularly easily.

In some embodiments, the fuel injection assembly further comprises a spring clip which is arranged and preloaded in longitudinal direction between a shoulder of the fuel injector and an end surface of the injector cup, in particular of the collar. The spring clip is in particular operable to bias the fuel injector away from the injector cup in longitudinal direction. In this way, the fuel injector can be, for example, pressed against a cylinder head of the internal combustion engine when the injector cup is positionally fixed with respect to the cylinder head.

In some embodiments, the tab is axially displaceable within the pocket. The tab may be inserted in longitudinal direction into the pocket in such fashion that it is axially displaceable in reciprocating fashion relative to the pocket. In this way, the assembly can be assembled particularly easily. In this way, the rotational orientation between the fuel injector and the injector cup can already be established while preloading the spring clip. In addition or alternatively, the fuel injection assembly is particularly insensitive to production tolerances and mounting tolerances relating to the relative longitudinal positions of the injector cup and the fuel injector.

Figure 2:
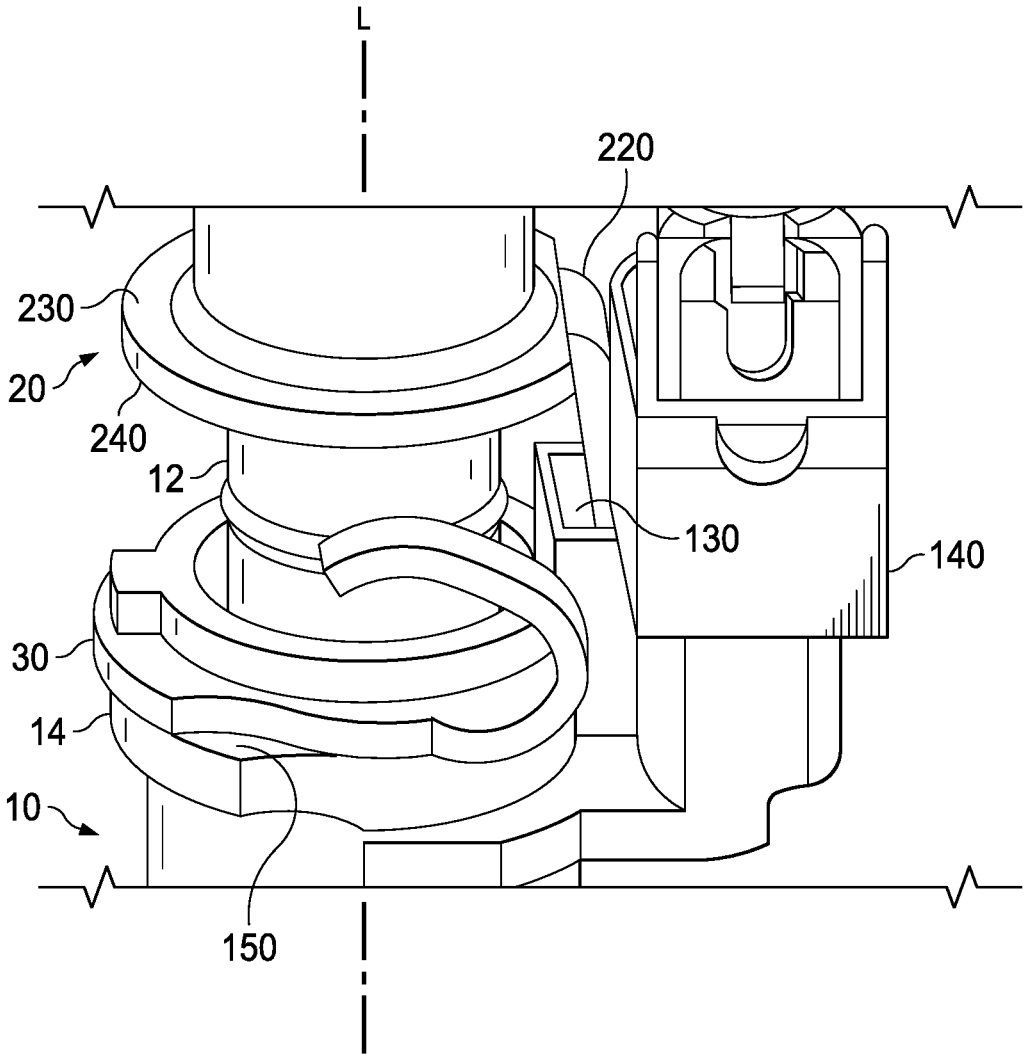
FIG. 2 shows a portion of the fuel injection assembly according to FIG. 1 in a perspective view in an un-assembled state.

FIG. 1 shows a schematic side view of a fuel injection assembly 1 according to an exemplary embodiment of the invention. FIG. 2 shows a perspective view of a portion of the fuel injection example 1.

The fuel injection example has a longitudinal axis L. It comprises a fuel injector 10 and an injector cup 20. The fuel injector 10 has a tubular metallic body 12 and a plastic housing 14. The injector cup 20 and a portion of the plastic housing 14 are longitudinally cut open in the representation of FIG. 1.

The fuel injector 10 extends the longitudinal axis L from a fuel inlet port 110 to a fuel outlet end 120. A portion of the metallic tubular body 12 between the fuel inlet port 110 and the fuel outlet end 120 is circumferentially enclosed by the plastic housing 14. The plastic housing 14 comprises an electrical connector 140. In the present embodiment, the plug direction of the electrical connector 140 is parallel to the longitudinal axis L. However, it is conceivable that the plug direction is inclined with respect to the longitudinal access. FIGS. 1 and 2 illustrate the electrical connector with a mating connector being plugged in.

The injector cup 20 is a one-piece part which comprises a recess 210 in which the fuel inlet port 110 of the fuel injector 10 is arranged. During assembling the fuel injection assembly 1, the fuel inlet port 110 of the fuel injector 10 is inserted in longitudinal direction L into the recess 210 though an opening 215 of the recess 210. The recess 210 extends into a base portion 205 of the injector cup 20 from the opening 215 in axial direction L from the fuel outlet end 120 towards the fuel inlet port 110. At its axial end remote from the opening 215, the recess 210 merges into a fluid inlet opening 250 of the injector cup 20. Through the fluid inlet opening 250 the injector cup is in particular connected or connectable to a fuel reservoir such as a fuel rail either directly or via a pipe. The fuel rail and/or the pipe (not shown in the figures) may be comprised by the fuel injection assembly 1.

A fluid tight seal is established between the fluid injector 10 and the injector cup 20 by means of a sealing ring 40 which is arranged laterally between the fuel inlet port 110 and a circumferential surface of the recess, i.e. an inner surface of the circumferential sidewall of the base portion 205. In FIG. 1, the sealing ring 40 is represented oversized relative to the lateral dimension of the recess 210 in order to indicate that the sealing ring 40 is compressed when the fuel inlet port 110 is inserted into the recess 210. In this way, a hydraulic connection is established between the fluid inlet opening 250 of the injector cup 20 and the fuel outlet end 120 of the fuel injector 10 through the recess 210 of the injector cup 20 into the fuel inlet port 110 of the fuel injector and further through the metallic tubular body 12 to the fuel outlet end 120 where the fuel is dispensed from the fuel injector 10 when a valve assembly of the fuel injector 10 is in an open configuration in order to release the fuel flow through one or more injection nozzles at the fuel outlet end 120.

At an axial end which faces in longitudinal direction towards the fuel outlet end 120, the injector cup 20 has a collar 230. The collar 230 extends circumferentially around the recess 210 and comprises an end surface 240 of the injector cup 20. The end surface 240 is coplanar with the opening 215 of the recess 210.

A spring clip 30 is arranged axially between the end surface 240 and a shoulder 150 of the plastic housing 14 of the fuel injector 10. A rotational position of the spring clip 30 with respect to the fuel injector 10 is fixed by means of a radial protrusion of the plastic housing 14 engaging into an inversely shaped cut-out of the spring clip 30 (see e.g. the leftmost portion of the spring clip 30 in FIG. 2).

In an assembled state of the fuel injection assembly, 1, the spring clip 30 is preloaded so that it is operable to bias the end surface 240 of the injector cup 20 and the shoulder 150 of the fuel injector in axial direction L away from one another. In this way, the fuel injector 10 can be pressed into contact with a cylinder head of an internal combustion engine. For preloading the spring clip 30, the fuel inlet port 110 of the fuel injector 10 is inserted into the recess and the injector cup 20 is moved in longitudinal direction L towards the fuel outlet end 120 relative to the fuel injector 10. The injector cup 20 or another part of the fuel injection assembly 1 which is positionally fixed with respect to the injector cup 20 may, for example, be fixed to the cylinder head for maintaining the preload of the spring clip 30.

In order to set a predetermined rotational orientation of the fuel injector 10 with respect to the injector cup 20, the fuel injection assembly 1 has an indexing assembly which comprises a tab 220 of the injector cup 20 and a pocket 130 of the fuel injector 10. The tab 220, which is a section of the one-piece part that represents the injector cup 20, has a main extension direction which is parallel to the longitudinal axis L and extends in axial direction towards the fuel outlet end 120 beyond the opening 215 of the recess 210 and beyond the collar 230. The injector cup 20 is, for example, a stamped and bended metal part, the recess 210 being introduced into the metal part by stamping and the tab 220 being bent from an orientation where its main extension direction is directed radially outward to the end configuration having its main extension direction parallel to the longitudinal axis L during manufacturing of the injector cup 20.

The tab 220 is inserted in longitudinal direction L into the pocket 130. In FIG. 2, for better representability of the fuel injection assembly 1, the fuel injection assembly 1 is shown in an un-assembled or partially assembled state, the tab 220 not yet being received in the pocket 130.

The pocket 130 is comprised by the plastic housing 14 of the fuel injector 10. The pocket 130 is arranged, in top view along the longitudinal axis L, radially between the electrical connector 140 and the metallic tubular body 12. In other words, the metallic tubular body 12, the pocket 130 and the electrical connector 140 follow one another in this order in radial outward direction. The pocket 130 extends into the plastic housing 14 from an opening of the pocket to a bottom surface of the pocket in longitudinal direction L towards the fuel outlet end 120 of the fuel injector 10. The tab 220 is received in the pocket 130 through the opening of the pocket 130 in such fashion that it is axially displaceable in reciprocating fashion relative to the pocket 130.

What is claimed is:

1. A fuel injection assembly having a longitudinal axis and comprising:

a fuel injector with a fuel inlet port and a fuel outlet end; and an injector cup with a recess receiving the fuel inlet port of the fuel injector through an opening of the recess and a first end facing the fuel injector;

wherein the injector cup comprises an annular collar extending circumferentially around the opening at the first end to a primary diameter;

a tab extending radially outward from the annular collar beyond the primary diameter and including an extension bent to extend parallel to the longitudinal axis beyond the annular collar, wherein no other portion of the injector cup extends beyond the annular collar towards the fuel outlet end; and the fuel injector comprises a pocket receiving the tab;

wherein the fuel inlet port comprises a metallic tubular body of the fuel injector and the fuel injector comprises a plastic housing laterally surrounding the metallic tubular body with an electrical connector in the plastic housing; and the pocket is defined in the plastic housing between the round collar and the electrical connector.

2. The fuel injection assembly of claim 1, wherein the annular collar comprises an end surface of the injector cup, the end surface coplanar with the opening of the recess.

3. The fuel injection assembly of claim 1, further comprising the pocket extending into the plastic housing from an opening of the pocket to a bottom surface of the pocket in a longitudinal direction towards the fuel outlet end of the fuel injector.

4. The fuel injection assembly of claim 3, further comprising the tab inserted in the longitudinal direction into the pocket through the opening in such fashion that it is axially displaceable in reciprocating fashion relative to the pocket.

5. The fuel injection assembly of claim 1, wherein the fuel injector comprises an electrical connector arranged subsequent to the pocket, in top view along the longitudinal axis, in a radial direction away from the metallic tubular body.

6. The fuel injection assembly of claim 1, wherein the injector cup is a one-piece part including the tab.

7. The fuel injection assembly of claim 1, further comprising a spring clip arranged and preloaded in longitudinal direction between a shoulder of the fuel injector and an end surface of the injector cup.

* * * * *